US006971376B2

(12) United States Patent
Monette et al.

(10) Patent No.: US 6,971,376 B2
(45) Date of Patent: Dec. 6, 2005

(54) ELECTRONIC FUEL CONDITIONING DEVICE

(75) Inventors: Gilles Monette, Mirabel (CA); Robert Boivin, Bellefeuille (CA)

(73) Assignee: Industries Ro-Gil Inc., Mirabel (CA)

( * ) Notice: Subject to any disclaimer, the term of this patent is extended or adjusted under 35 U.S.C. 154(b) by 0 days.

(21) Appl. No.: 10/494,809

(22) PCT Filed: Sep. 15, 2003

(86) PCT No.: PCT/CA03/01402

§ 371 (c)(1),
(2), (4) Date: May 6, 2004

(87) PCT Pub. No.: WO2004/025110

PCT Pub. Date: Mar. 25, 2004

(65) Prior Publication Data

US 2005/0016508 A1 Jan. 27, 2005

(30) Foreign Application Priority Data

Sep. 13, 2002 (CA) ..... 2403049

(51) Int. Cl.[7] ..... F02M 27/04
(52) U.S. Cl. ..... 123/538
(58) Field of Search ..... 123/536–538

(56) References Cited

U.S. PATENT DOCUMENTS

| | | | | |
|---|---|---|---|---|
| 3,976,726 | A * | 8/1976 | Johnson | 261/1 |
| 5,048,498 | A * | 9/1991 | Cardan | 123/538 |
| 5,134,985 | A * | 8/1992 | Rao | 123/538 |
| 5,517,975 | A * | 5/1996 | Iwata | 123/538 |
| 6,748,933 | B2 * | 6/2004 | Prevost | 123/538 |
| 6,802,706 | B2 * | 10/2004 | Collesan | 431/2 |

FOREIGN PATENT DOCUMENTS

| | | |
|---|---|---|
| EP | 0894969 | 2/1999 |
| WO | 0015957 | 3/2000 |

* cited by examiner

*Primary Examiner*—Marguerite McMahon
(74) *Attorney, Agent, or Firm*—ROBIC; Gonzalo Lavin

(57) ABSTRACT

A fuel conditioning device (1) for attachment to a fuel line (5) of a fuel combustion machine to improve combustion efficiency thereof. The device (1) includes a frequency controlled signal generator (14) powered by a power supply (2). The frequency controlled signal generator (14) has a first output being connected to the first output wire (8) coiled around the fuel line (5) for producing a first shark dorsal waveform voltage signal (15) oscillating at a predetermined frequency. The frequency controlled signal generator (14) has a second output connected to the second output wire (9) coiled around the fuel line (5) for producing a second shark dorsal waveform voltage signal (16) oscillating at the predetermined frequency. The second shark dorsal waveform voltage signal (16) is an inverted mirror signal of the first shark dorsal waveform voltage signal (15).

14 Claims, 10 Drawing Sheets

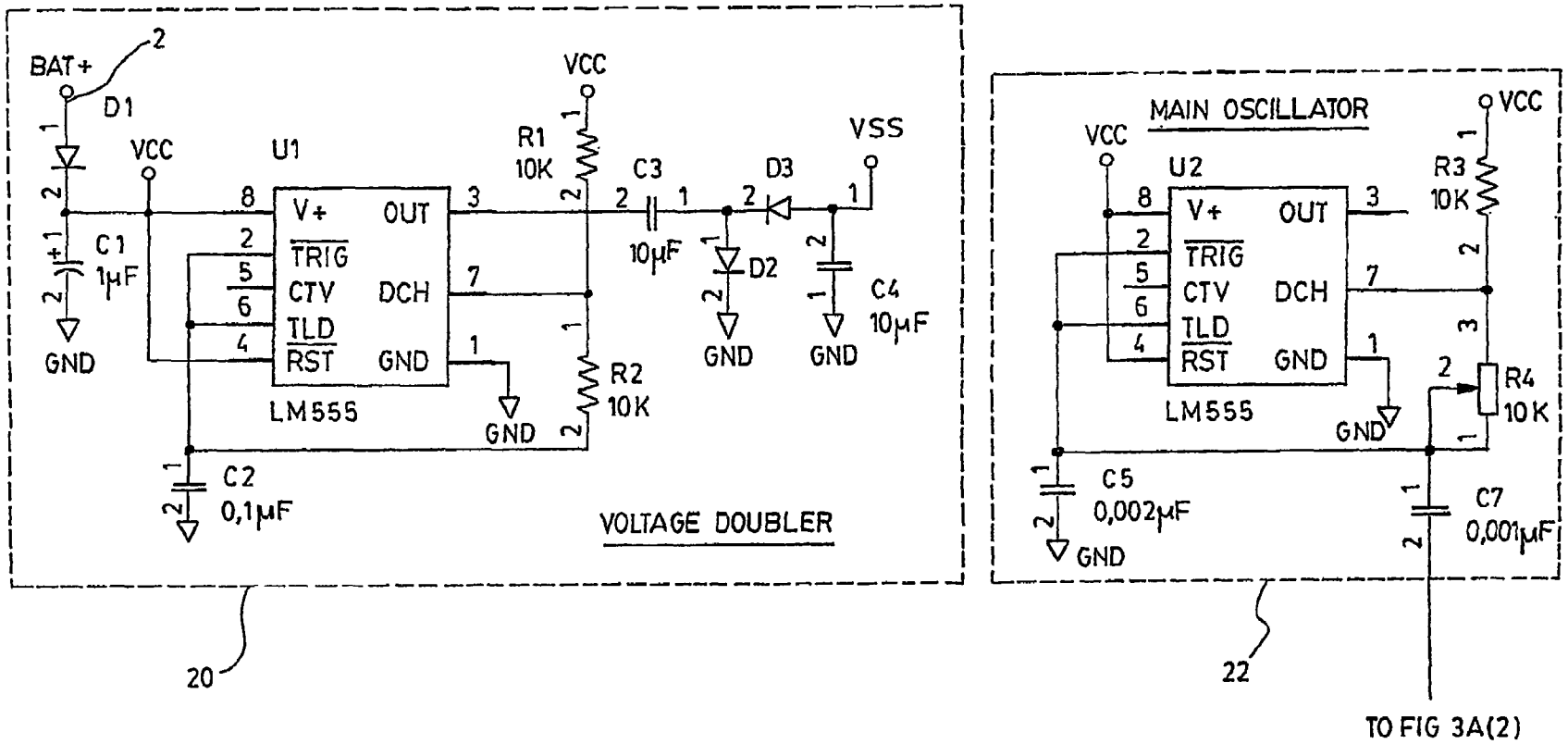
FIG. 3A(1)

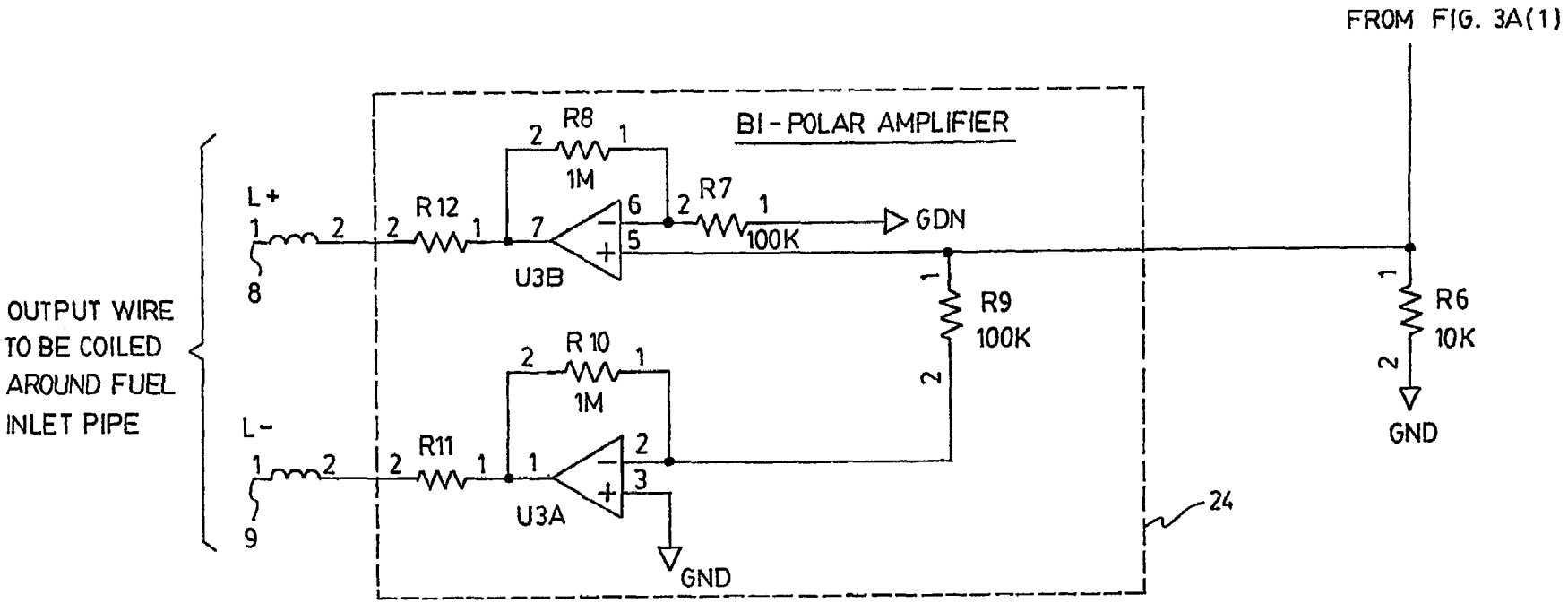
FIG. 3A(2)

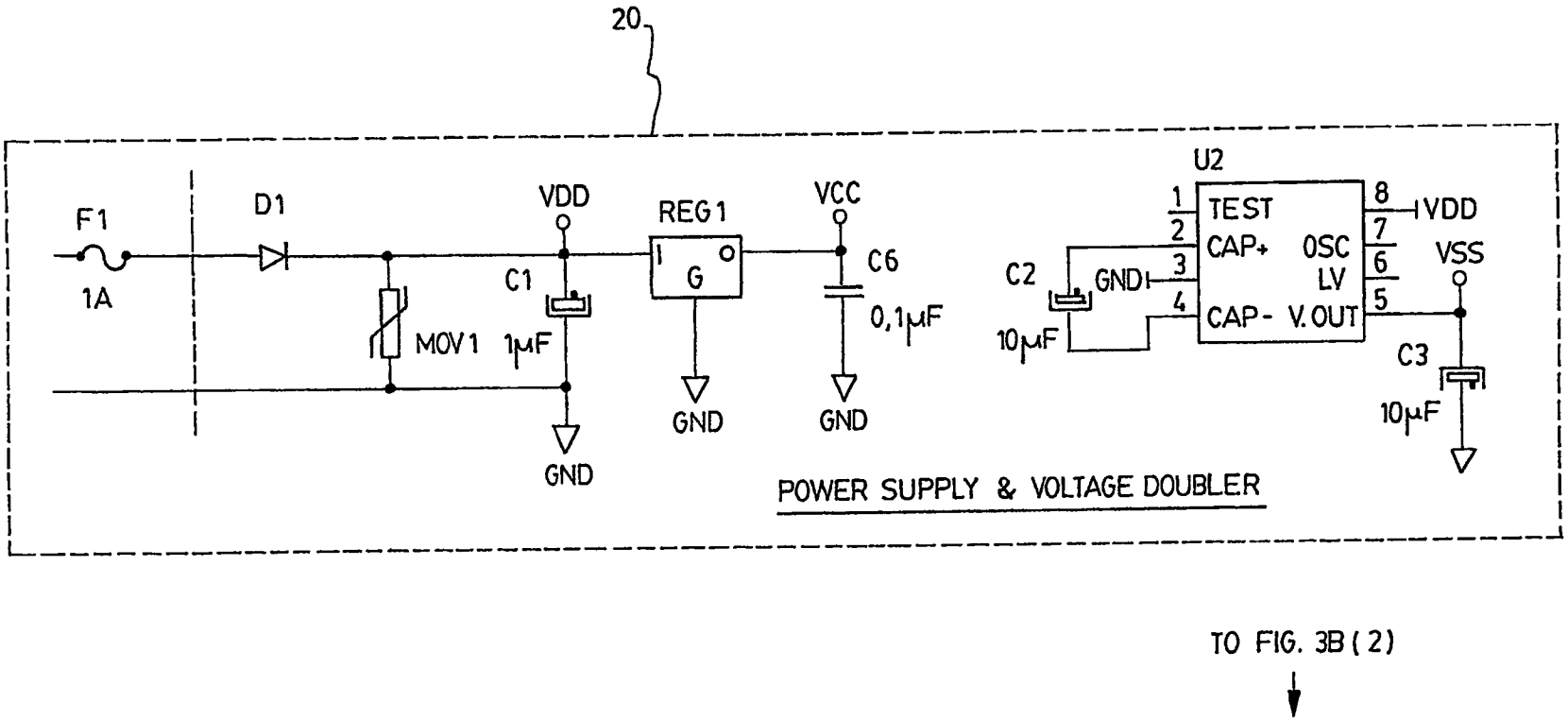
FIG. 3B(1)

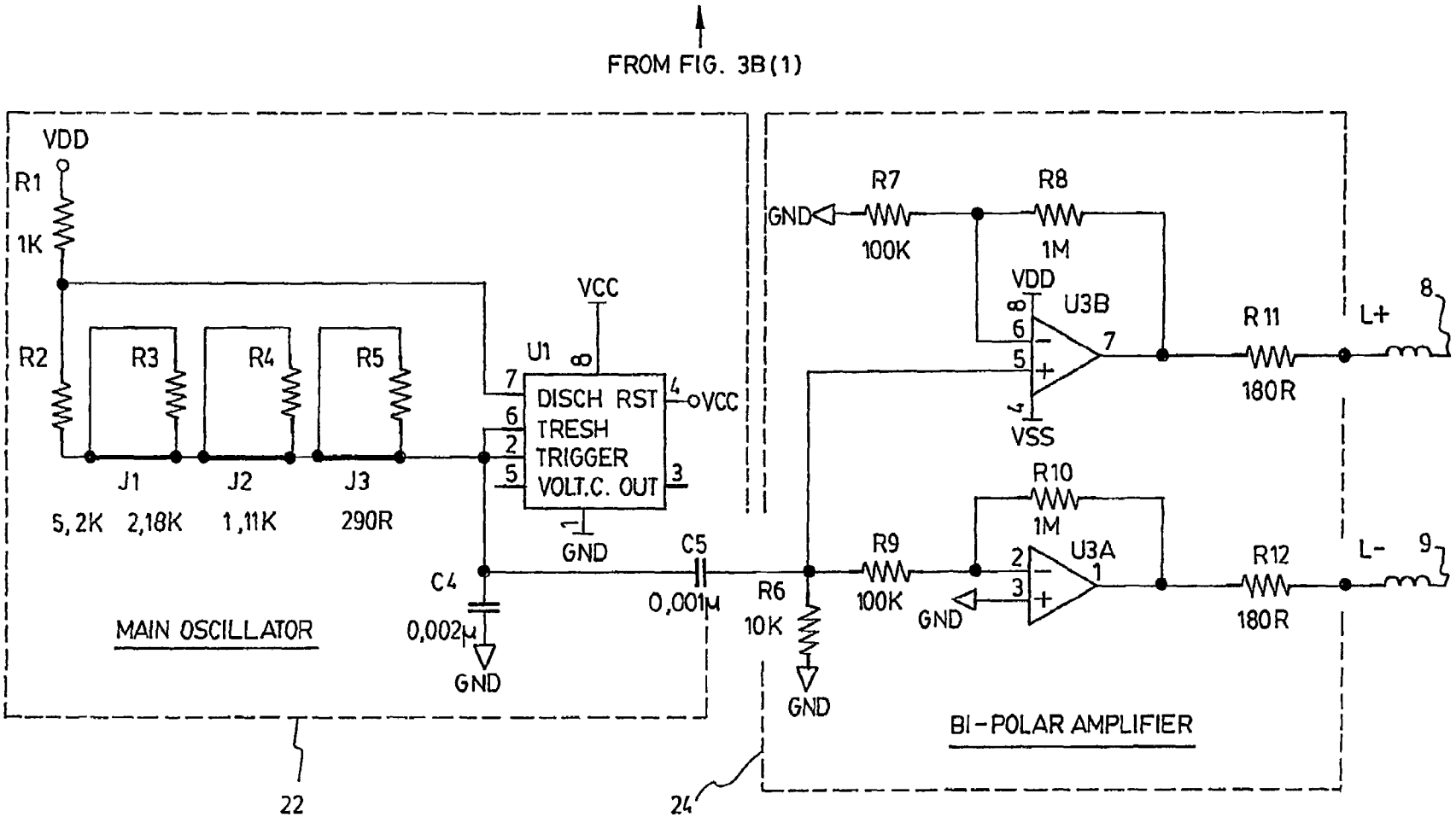
FIG. 3B (2)

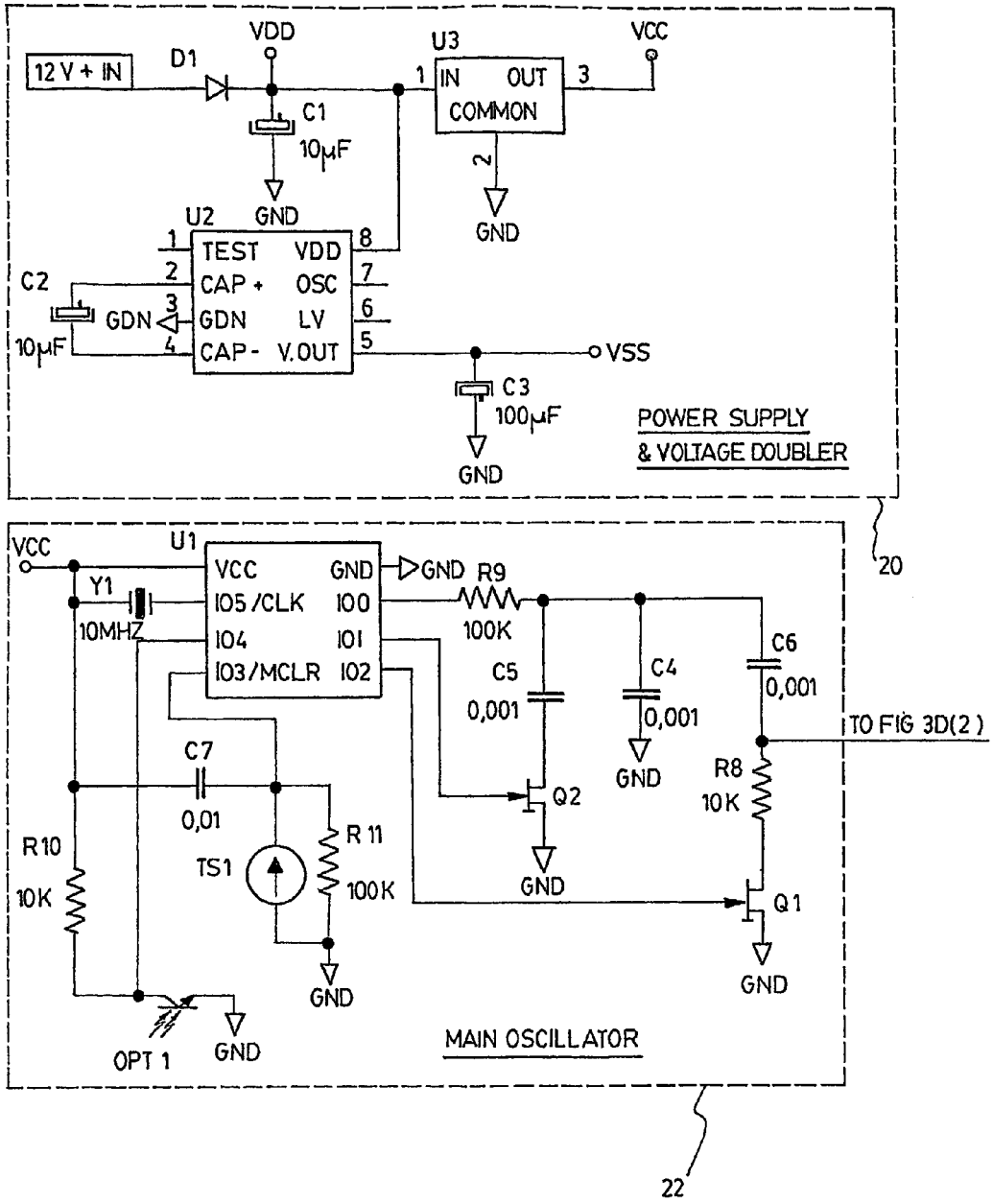
FIG. 3D (1)

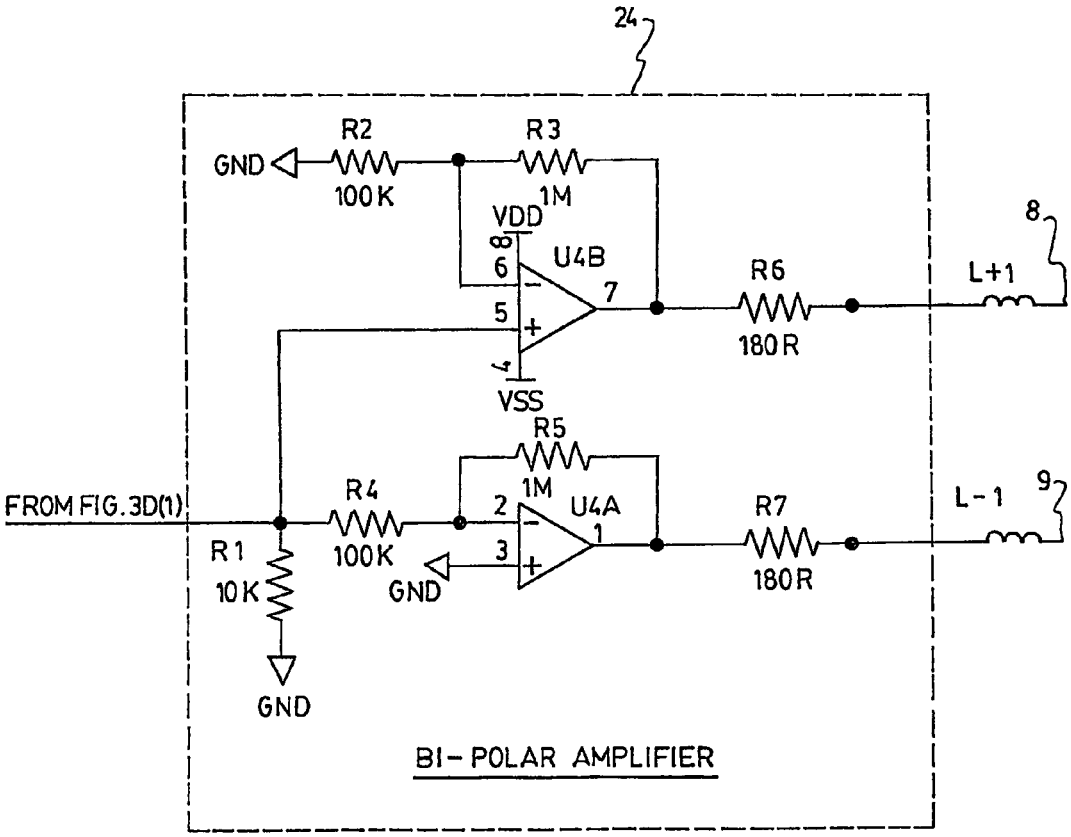
FIG. 3D(2)

ELECTRONIC FUEL CONDITIONING DEVICE

FIELD OF THE INVENTION

The present invention relates to a fuel conditioning device for improving the fuel efficiency and lowering pollution emissions of a fuel combustion machine.

BACKGROUND OF THE INVENTION

At about the beginning of this century, Nicolai Tesla discovered the relationship between the polarization of combustible matter and the quality of the combustion. Since then, some apparatus for improving combustion efficiency have been proposed in the market, but have enjoyed very limited success if any.

SUMMARY OF THE INVENTION

It is an object of the present invention to provide a fuel conditioning device for improving the combustion efficiency and lowering pollution emissions of a combustion machine, such as a vehicle combustion engine or a heating system, compared to prior art fuel conditioning devices of similar kind.

According to the present invention, there is provided an electronic fuel conditioning device for attachment to a fuel line of a fuel combustion machine to improve combustion efficiency thereof, the device comprising:

a frequency controlled signal generator powered by a power supply, the frequency controlled signal generator having a first output being connected to a first output wire coiled around the fuel line for producing a first shark dorsal waveform voltage signal oscillating at a predetermined frequency, and a second output being connected to a second output wire coiled around the fuel line for producing a second shark dorsal waveform voltage signal oscillating at the predetermined frequency, the second shark dorsal voltage signal being an inverted mirror signal of the first shark dorsal waveform voltage signal.

The invention, its use and its advantages will be better understood upon reading of the following non-restrictive description of preferred embodiments thereof, made with reference to the accompanying drawings, in which like numbers refer to like elements.

BRIEF DESCRIPTION OF THE DRAWINGS

FIG. 3A is a block circuit diagram of internal elements of a fuel conditioning device according to a first preferred embodiment of the present invention.

FIG. 3B is a block circuit diagram of internal elements of a fuel conditioning device according to a second preferred embodiment of the present invention.

FIG. 3D is a block circuit diagram of internal elements of a fuel conditioning device according to a fourth preferred embodiment of the present invention.

DETAILED DESCRIPTION OF THE INVENTION

Figure 1:
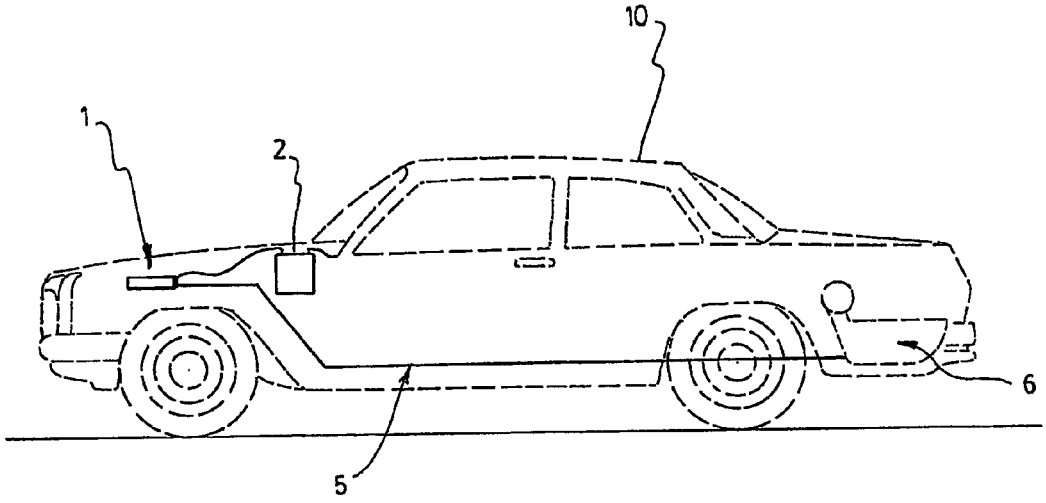
FIG. 1 is a side partially sectional view of a vehicle provided with an electronic fuel conditioning device according to a preferred embodiment of the present invention.

Referring to FIG. 1, there is shown a vehicle 10 provided with an internal combustion engine (not shown). The vehicle 10 has a fuel tank 6 that is connected to a fuel line 5 which is in turn connected to the combustion engine. A fuel conditioning device 1 according to a preferred embodiment of the present invention is installed on the existing fuel line 5 of the vehicle 10. The fuel conditioning device 1 is preferably powered by a 12 V battery 2 of the vehicle 10. The fuel conditioning device 1 may alternatively be powered by other means as persons skilled in the art will understand.

It will also be understood by those skilled in the art that the fuel conditioning device 1 according to the present invention may be used in different applications to improve fuel consumption efficiency of fuel combustion machines. For example, a fuel conditioning device according to the present invention may also be installed in a fuel supply line of a heating system.

Figure 2:
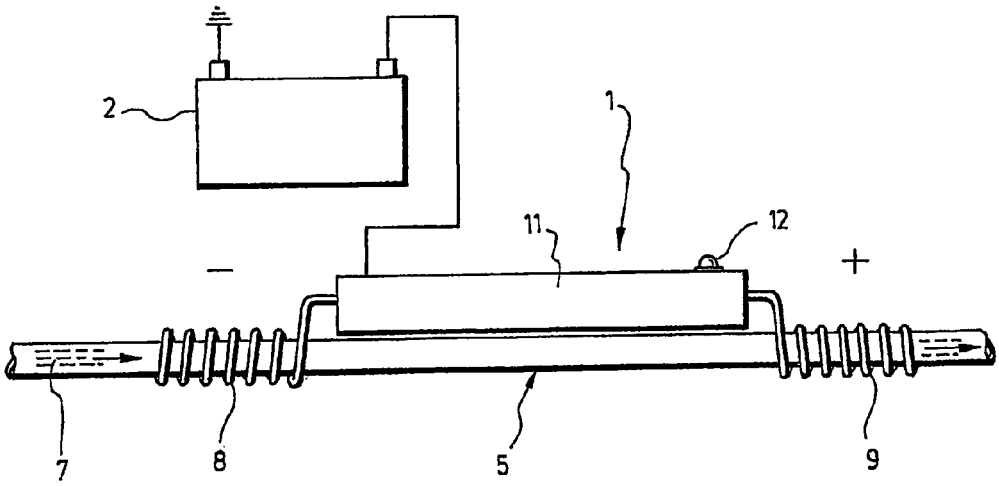
FIG. 2 is a more detailed side view of the electronic fuel conditioning shown in FIG. 1.

Referring FIG. 2, the fuel conditioning device 1 according to a preferred embodiment of the present invention has an electronic control box or housing 11 powered by the battery 2 in the case of the vehicle 10 shown in FIG. 1, or by any other suitable power supply in the case of a heating system for example. Two conductor wires 8 and 9 come out from the housing 11 and are wound around the fuel line 5. It should be noted that the number of turns and the direction of rotation are dependent of the particular application. In case of a vehicle, the number of turns preferably ranges from 7 to 22. In terms of transformer terminology, the windings 8 and 9 can be seen as a transformer primary, the fuel line 5 can be seen as the transformer core and the fuel 7 flowing through the fuel line 5 can be seen as the transformer secondary.

Figure 3:
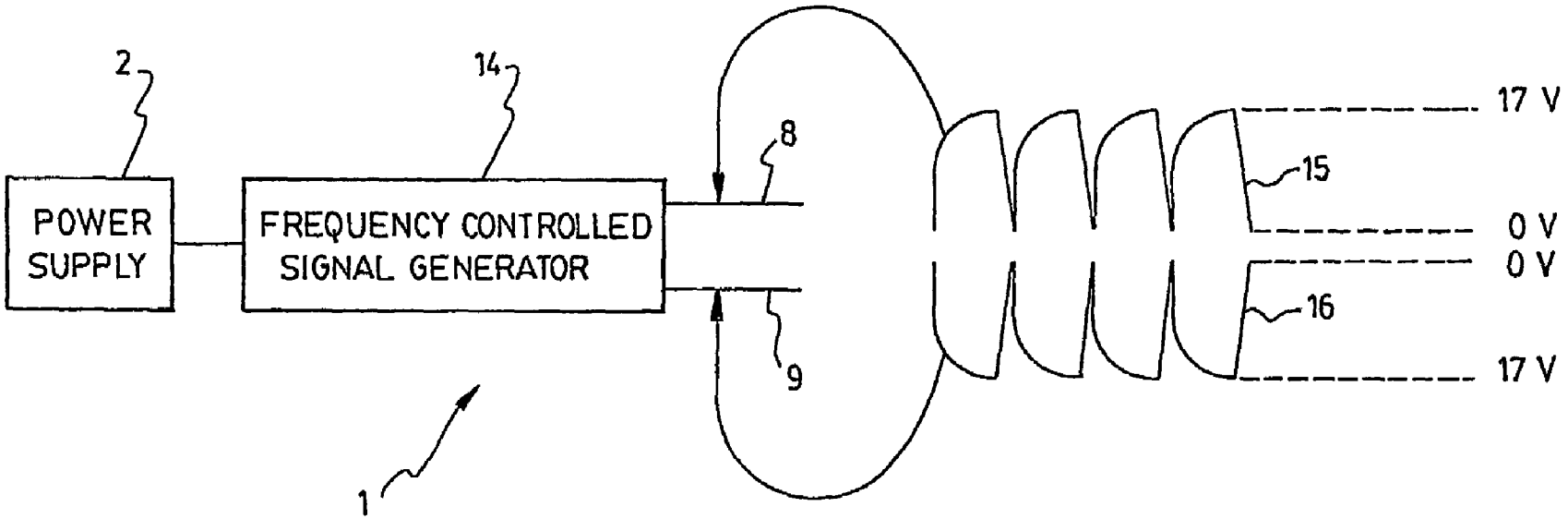
FIG. 3 is a conceptual block diagram of a fuel conditioning device according to the present invention.

Referring to FIGS. 2 and 3, the electronic fuel conditioning device 1 according to the present invention includes a frequency controlled signal generator 14 powered by a power supply 2. The frequency controlled signal generator 14 has a first output being connected to the first output wire 8 coiled around the fuel line 5 for producing a first shark dorsal waveform voltage signal 15 oscillating at a predetermined frequency. The frequency controlled signal generator 14 also has a second output connected to the second output wire 9 coiled around the fuel line 5 for producing a second shark dorsal waveform voltage signal 16 oscillating at the predetermined frequency. The second shark dorsal waveform voltage signal 16 is an inverted mirror signal of the first shark dorsal waveform voltage signal 15.

Preferably, as mentioned above, the power supply 2 includes a vehicle battery 2 providing an input d.c. voltage of about 12 V. The frequency controlled signal generator 14 is housed in the housing 11 attached to the fuel line 5. The housing 11 may be attached or secured to the fuel line or placed in an adjacent position. The housing 11 may be provided with a light indicator 12 for providing an indication of operation of the electronic fuel conditioning device 1. The housing 11 may be made of plastic or metal, and contains the circuitry of the generator 14. This generator 14 may be split in three blocks which are inter-linked. All of this may be built over a printed circuit of approximately 1"×2" (2.5 cm×5 cm) using integrated circuits of regular size which are easily available in the market. It may also be possible to use surface-mount type of materials, thus resulting in a smaller electronic fuel conditioning device.

Referring to FIG. 3A, there is shown a block circuit diagram of internal elements of a fuel conditioning device 1 according to a first preferred embodiment of the present invention.

A first element of the electronic fuel conditioning device 1 is a voltage doubler 20 which has an input that is connected to a d.c power source 2. In the present example, the input may be connected to the 12 V vehicle battery 2 through diode D1 at the positive input of the power supply to protect it against polarity reversal. The input feeds the positive supply of all circuitry and is filtered by capacitor C1, which has a value of 1 $\mu$F in this example. The d.c. voltage at this point is labeled Vcc and has a value of about +12 V. An integrated circuit U1 (presently an LM555) is mounted as an astable oscillator. The resistors R1, R2 and capacitor C2 (having values of 10 KoHm and 10 $\mu$F) determine the frequency of this oscillator (approximately 3 kHz). A square wave outputs at output pin 3 and couples via capacitor C3 at diodes D2 and D3. This output signal feeds a stocking capacitor C4, which filters the so created d.c. negative voltage, labeled Vss having a value of about −12 V.

A second element of the electronic fuel conditioning device 1 is a main oscillator 22, which is built around circuit U2, which may be a LM555, (it may also work with a CD4046). It is an astable oscillator which frequency is determined by resistor R3 and capacitor CS (having values of 10 Kohm and 0.002 $\mu$F). A potentiometer R4 is used as a frequency adjustment so as to adapt the generator 14 to the type of fuel, and/or the type of line on which the two output conducting wires 8 and 9 are wound. The wave produced resembles a shark dorsal on an oscilloscope and will output at pin 2 of the LM555 and sources a bi-polar amplifier 24, which is described below, via capacitor C7 and registers to resistor R6 (having values of 0.001 $\mu$F and 10 Kohm).

The third element of the electronic fuel conditioning device 1 is the bi-polar amplifier 24. It is built around a dual operational amplifier composed of U3A and U3B, which may be embodied by a TL082. It is fed on a positive side by Vcc and on a negative side by Vss. The first amplifier is mounted as an inverting amplifier and its gain is determined by resistors R9 and R10 (100 Kohm and 1 Mohm), and feeds the negative output at coil L−, which represents the output wire 9. The second amplifier is mounted as non-inverting amplifier which gain is determined by resistors R7 and R8 (100 Kohm and 1 Mohm) and feeds the positive output at coil L+, which represents the first output wire 8. Both resistors R11 and R12 are used as current limiters to protect against accidental short circuits.

Figure 4:
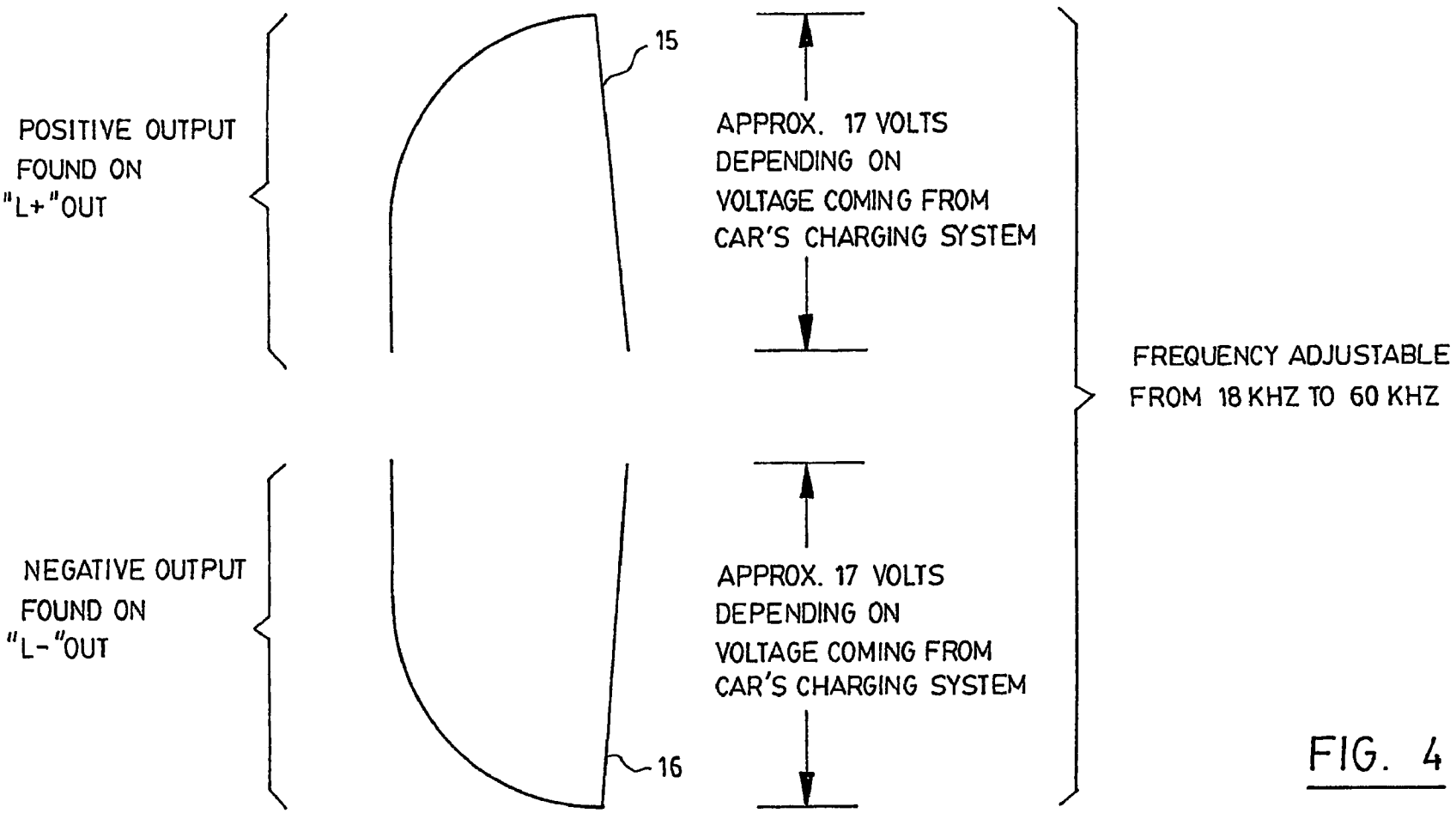
FIG. 4 is a schematic diagram showing output voltage curves at the output wires of a fuel conditioning device according to a preferred embodiment of the present invention.

As illustrated in FIGS. 3 and 4, if one takes a look on an oscilloscope to the waves 15 that the fuel conditioning device 1 produces on output wire 8, it is seen that it resembles to a shark's dorsal. It exponentially rises to its maximum and then reverses direction abruptly to its minimum. The inverted mirror image is found on the opposite polarity on output wire 9. The preferred frequency window of such waves ranges from about few kilohertz to nearly 60 kilohertz.

Figure 3C:
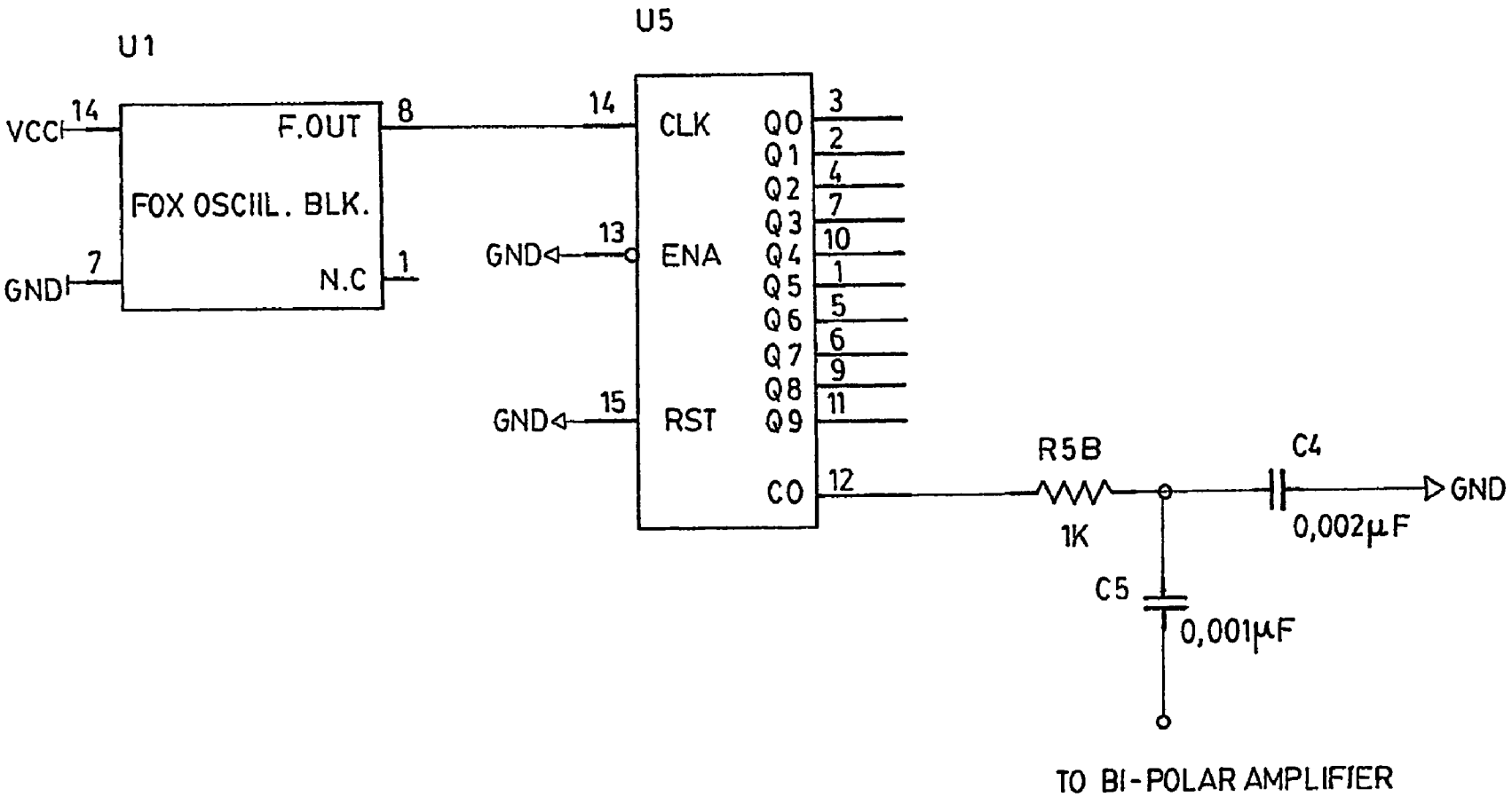
FIG. 3C is a block circuit diagram of internal elements of a fuel conditioning device according to a third preferred embodiment of the present invention.

Referring to FIGS. 3B and 3C, one can appreciate that four modifications have been added to the circuitry shown in FIG. 3A to improve its performance. First, an MOV (metal oxide semiconductor) is added to protect the circuitry against voltage surge that can be present on the 12 volt power supply. The second modification is the use of an IC dedicated to voltage doubling, an ICL7662. The ICL7662 outputs a negative voltage that is more proportional to the positive input supply than the LM555 (U1) shown in FIG. 3A. More stable, the ICL7662 is able to feed up to 100 mA comparatively to the configuration shown in FIG. 3A that could give about 30 mA maximum. The third modification is the adding of a voltage regulator REG1 feeding the main oscillator circuit 22. The voltage regulator outputs 5 volts and is regulated whatever the incoming supply since this supply can vary, such as in the case of vehicle batteries, up to about 15 volts when the charging system is in function. The fourth modification is more of a practical order. It eliminates the use of the frequency adjustment's potentiometer R4 shown in FIG. 3A. As shown in FIG. 3B, four fixed value resistors in series R2, R3, R4 and R5 are installed with three of them being jumpers. When the unit is delivered, its frequency is 48 kHz. If one or more of the jumpers are cut, the frequency will then be of a new value out of four. These values are 26 kHz, 32 kHz, 36 kHz and 48 kHz.

Referring to FIG. 3B, there is shown a second preferred embodiment of internal elements of an electronic fuel conditioning device according to the present invention. Once again, the circuitry is split in three blocks which are interlinked. All of this is built over a printed circuit of approximately one inch by two. It should be noted that the use of a surface mount version of the electronic parts eventually reduces the size of the resulting device. The device may be built on a malleable printed circuit looking more like a small credit card but more flexible so that it can be installed by just rolling it over the conduit. This device could be covered with some adhesive with a protective film that may be removed just before the instalment so as to reduce the installation time.

The first block is the voltage doubler 20. A diode D1 at the positive input of the power supply protects against polarity reversal. It feeds the positive supply of all circuitry and is filtered by capacitor C1. This voltage is labelled Vdd. Parallel to this supply, the metal oxide semiconductor MOV1 is used to protect the circuitry against surges that could be present on the 12 volts supply line.

Capacitor C1 filters this Vdd line. A regulator REG1 outputs the 5 volts regulated to supply the positive voltage feeding the main oscillator 22 and is referred to as Vcc. This tension is stabilised by capacitor C6. An integrated circuit U2 (ICL7662) is used as a voltage doubler. Its input supply is stabilised by capacitor C2 and its negative output is stabilised by capacitor C3. This negative output is referred to as Vss.

The second block is the main oscillator 22. The main oscillator is built around U1, an LM555, which is an astable oscillator. Its positive supply is connected to Vcc (5 volts regulated) and its negative supply goes directly to 0 volt, ground. Its frequency is determined by the R1 resistor and capacitor C4 and also the resistor network composed of R2, R3, R4 and R5. The three last resistors are bypassed with three jumpers witch are labelled J1, J2 and J3, meaning that the device, when delivered, is tuned to 48 kHz. To get it down to 36 kHz, one needs to cut jumper J1. If one wants 32 kHz, one needs to cut also jumper J2 and for 26 kHz, then one also cuts jumper J3. This offers the opportunity to adapt the device to the type of conduit and/or the type of combustible treated. The wave produced resembles a shark dorsal on an oscilloscope and outputs at pin 2 of the LM555 integrated circuit and sources the bi-polarity amplifier 24 via capacitor C5 and registers to resistor R6.

Referring to FIG. 3C, it should be noted that in some special cases, the frequency needs to be higher. In those cases, a crystal oscillator is used so that the output frequency is as stable as possible. Integrated circuit U1, of type <<Fox crystal oscillator>> feeds the clock input of U5, (CD4017) and its output sources the bi-polar amplifier 24. The bi-polar amplifier 24 and the voltage doubler 20 stay the same as the above.

Referring back to FIG. 3B, the third block, or bi-polar amplifier 24, is built around a dual operational amplifier composed of U3A and U3B. The bi-polar amplifier 24, which may be a TL082, is fed on positive side by Vdd (+12 volt nominal) and negative side by Vss (−12 volt nominal). The first amplifier is mounted as an inverting amplifier and its gain is determined by resistors R9 and R10 and feeds the negative output at coil L−, which is representative of output wire 9. The second one is mounted as non-inverting amplifier witch gain is determined by resistors R7 and R8 and feeds the positive output at coil L+, which is representative of output wire 8. Both resistors R11 and R12 are used as a current limiter to protect against accidental short-circuit. The negative supply being more stable, the negative output completes more accurately the positive.

Referring to FIG. 3D, one other improvement consists in using a microprocessor as the main oscillator 22. It should be noted that the power supply 2, the voltage doubler 20 and the bi-polar amplifier 24 are not changed from the design described above.

The microprocessor is referred to as U1. Its working frequency is 10 MHz and is determined by crystal Y1. The IO4 input is connected to the junction of R10 and OPT1. This ensemble is an infrared detector and is used as the exterior world communication channel. Through this channel, one can input the choice of parameter so that the system may be adapted to the environment as far as the type of combustible and the type of piping used. It should be noted that a handheld type of IR transmitter allows the installer to communicate with the module so to adapt this module. Line IO3 is connected to the junction of capacitor C7, resistor R11 and temperature transducer TS1. This gives a reference of the ambient temperature and, from the internal program, it allows adjusting the parameter as far as frequency, waveform and amplification of the shark dorsal waveform signals are concerned. The output labelled IO2 drives transistor Q1 which is connected from resistor R8 to ground. This circuit adapts the impedance depending on output frequency. Transistor Q2 is connected to capacitor C5. The IO0 output tied to resistor R9, followed by C4 to ground corrects, with the preceding circuit, the waveform depending on pre-programmed parameters. This ensemble becomes the output frequency which sources the bi-polar amplifier.

The fuel conditioning device according to the present invention may be used in many applications such as propane gas systems, natural gas systems, water conditioning systems, air systems, hydraulic oil systems, etc. It has also been observed that the fuel conditioning device may produce a counter effect over rust in several components of a vehicle.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. An electronic fuel conditioning device (1) for attachment to a fuel line (5) of a fuel combustion machine to improve combustion efficiency thereof, the device comprising:

a frequency controlled signal generator (14) powered by a power supply (2), the frequency controlled signal generator (14) having a first output being connected to a first output wire (8) coiled around the fuel line (5) for producing a first shark dorsal waveform voltage signal (15) oscillating at a predetermined frequency, and a second output being connected to a second output wire (9) coiled around the fuel line (5) for producing a second shark dorsal waveform voltage signal (16) oscillating at the predetermined frequency, the second shark dorsal voltage signal (16) being an inverted mirror signal of the first shark dorsal waveform voltage signal (15);

wherein the frequency controlled signal generator (14) includes:

a main oscillator circuit (22) for producing a shark dorsal waveform oscillating at the predetermined frequency;

a bi-polar-amplifier (24) coupled to the main oscillator circuit (22) to produce the first and second shark dorsal waveform voltage signals (15, 16); and a voltage doubler circuit (20) for powering the bi-polar amplifier circuit (24) with a positive d.c. voltage (Vcc) and a negative d.c. voltage (Vss).

2. The electronic fuel conditioning device (1) according to claim 1, wherein the power supply (2) includes a vehicle battery providing an input d.c. voltage of about 12 V and wherein the frequency controlled signal generator (14) is housed in a housing (11) attached to the fuel line (5).

3. The electronic fuel conditioning device (1) according to claim 1, wherein the voltage doubler circuit (20) includes an input diode (D1) for protection against polarity reversal and a filtering capacitor (C1) for filtering and stabilizing an input d.c. voltage.

4. The electronic fuel conditioning device (1) according to claim 3, wherein the power doubler circuit (20) includes an astable oscillator integrated circuit (U1) having an output being connected to a capacitor and diode circuit (C3, C4, D2, D3) for producing the negative d.c. voltage (Vss).

5. The electronic fuel conditioning device (1) according to claim 4, wherein the main oscillator circuit (22) includes a LM555 astable oscillator integrated circuit (U2) being connected to a resistance (R3), a variable resistance (R4) and capacitor (CS) for adjusting the predetermined frequency, a trigger pin of the LM555 astable oscillator integrated circuit (U2) being connected to an input of the bi-polar amplifier (24) through a coupling capacitor (C7) and coupling resistance (R6).

6. The electronic fuel conditioning device (1) according to claim 5, wherein the bi-polar amplifier (24) includes a TL082 integrated circuit having a first non-inverting amplifier and a second inverting amplifier for producing the first and second shark dorsal voltage signals (15, 16).

7. The electronic fuel conditioning device (1) according to claim 3, wherein the voltage doubler circuit (20) further includes a metal oxide semiconductor for protection against voltage surges of d.c. incoming power.

8. The electronic fuel conditioning device (1) according to claim 7, wherein the voltage doubler circuit (20) further includes a ICL 7662 integrated circuit for producing the negative d.c. voltage (Vss).

9. The electronic fuel conditioning device (1) according to claim 8, wherein the voltage doubler circuit (20) further includes a voltage regulator (REG1) for feeding the main oscillator circuit (22).

10. The electronic fuel conditioning device (1) according to claim 9, wherein the main oscillator circuit (22) includes a set of three resistors (R3, R4, R5) for adjusting the predetermined frequency.

11. The electronic fuel conditioning device (1) according to claim 10, wherein the predetermined frequency is adjusted to 48 kHz, 36 kHz, 32 kHz or 26 kHz according to the related jumper over resistance (R3, R4, R5) that are cut.

12. The electronic fuel conditioning device (1) according to claim 10, wherein the main oscillator circuit (22) includes a crystal oscillator circuit for feeding a clock input of a CD4017 integrated circuit, the CD4017 integrated circuit having an output for feeding the bi-polar amplifier (24).

13. The electronic fuel conditioning device (1) according to claim 12, wherein the main oscillator circuit (22) includes a microprocessor connected to an infrared detector and communication channel for controlling the predetermined frequency, amplitudes and shapes of the first and second shark dorsal waveform voltage signals (15, 16).

14. The electronic fuel conditioning device (1) according to claim 12, wherein the main oscillator circuit (22) includes a temperature sensor for obtaining a temperature value used to correct the predetermined frequency, amplitudes and shapes of the first and second shark dorsal voltage signals (15, 16).

* * * * *